US010258088B2

(12) United States Patent
Plott et al.

(10) Patent No.: US 10,258,088 B2
(45) Date of Patent: Apr. 16, 2019

(54) DIFFUSER DEVICE, SYSTEM AND METHOD

(71) Applicant: MNA Holdings, LLC, Providence, UT (US)

(72) Inventors: Matthew R. Plott, Providence, UT (US); Carson C. Cook, Clackamas, OR (US)

(73) Assignee: MNA Holdings, LLC, Providence, UT (US)

( * ) Notice: Subject to any disclaimer, the term of this patent is extended or adjusted under 35 U.S.C. 154(b) by 101 days.

(21) Appl. No.: 15/469,445

(22) Filed: Mar. 24, 2017

(65) Prior Publication Data

US 2017/0290367 A1 Oct. 12, 2017

Related U.S. Application Data

(60) Provisional application No. 62/319,075, filed on Apr. 6, 2016.

(51) Int. Cl.

| | |
|---|---|
| ***A24F 47/00*** | (2006.01) |
| ***A24F 13/00*** | (2006.01) |
| ***A24F 7/02*** | (2006.01) |

(52) U.S. Cl.

CPC ..... *A24F 47/008* (2013.01); *A24F 7/02* (2013.01); *A24F 13/00* (2013.01)

(58) Field of Classification Search

CPC ..... A24F 47/008

See application file for complete search history.

(56) References Cited

U.S. PATENT DOCUMENTS

| | | | | |
|---|---|---|---|---|
| 5,353,814 | A | 10/1994 | Martin | |
| 5,530,225 | A * | 6/1996 | Hajaligol | A24F 47/008 131/194 |
| 7,997,275 | B2 | 8/2011 | Quinn | |
| 8,528,562 | B2 | 9/2013 | Smith et al. | |
| 2002/0023651 | A1 | 2/2002 | Japuntich et al. | |
| 2003/0005934 | A1 | 1/2003 | Japuntich et al. | |

(Continued)

OTHER PUBLICATIONS

Smokebuddy, Smokebuddy Original product, Internet publication located at http://www.smokebuddy.com/index.php/personal-air-filter/smokebuddy-original.html (2018).

(Continued)

*Primary Examiner* — James Harvey
(74) *Attorney, Agent, or Firm* — David L. Stott

(57) ABSTRACT

Embodiments of a diffuser device, system, and method for diffusing exhaled vapor that is inhaled from a vaper producing device. In one embodiment, the diffuser device includes a first tubular portion, a second tubular portion, and a removable, disposable filter. The first tubular portion includes a length and a first interior surface that defines a first bore extending through the first tubular portion along the length, the first interior surface defining a first ledge. The second tubular portion includes a second interior surface that defines a second bore. The second tubular portion is removably and rotatably coupled to the first tubular portion such that the second bore is coaxial with the first bore. The removable, disposable filter may include a cylindrical structure sized to be positioned within the first bore between the first ledge and an end of the second tubular portion.

20 Claims, 3 Drawing Sheets

(56) References Cited

U.S. PATENT DOCUMENTS

| | | | | |
|---|---|---|---|---|
| 2008/0038207 | A1 | 2/2008 | Edwards et al. | |
| 2008/0245364 | A1 | 10/2008 | Patterson | |
| 2009/0293878 | A1 | 12/2009 | Tatarek | |
| 2011/0030691 | A1 | 2/2011 | Campbell | |
| 2011/0290264 | A1 | 12/2011 | Carse | |
| 2015/0105683 | A1 | 4/2015 | Bos | |
| 2015/0150305 | A1 | 6/2015 | Shenkal | |
| 2015/0173417 | A1 | 6/2015 | Gennrich et al. | |
| 2015/0257444 | A1 | 9/2015 | Chung | |
| 2015/0257446 | A1 | 9/2015 | Chung | |
| 2015/0374035 | A1* | 12/2015 | Sanchez | A24F 47/008 131/328 |
| 2016/0270444 | A1* | 9/2016 | Lin | A24F 47/008 |
| 2016/0286863 | A1* | 10/2016 | Lin | A24F 47/008 |
| 2017/0119054 | A1* | 5/2017 | Zinovik | A24F 47/008 |
| 2017/0290367 | A1* | 10/2017 | Plott | A24F 13/00 |
| 2017/0295845 | A1* | 10/2017 | Bajpai | A24F 47/008 |
| 2018/0116277 | A1* | 5/2018 | Besso | A61K 8/347 |

OTHER PUBLICATIONS

Elevated Products, LLC, GroovTube Mini product, Internet publication located at http://www.groov-tube.com/groovtube-mini-2-pack-portable-sploof/ (2018).

* cited by examiner

DIFFUSER DEVICE, SYSTEM AND METHOD

CROSS-REFERENCE TO RELATED APPLICATIONS

The present application claims the benefit of U.S. Provisional Patent Application No. 62/319,075, filed on Apr. 6, 2016, the disclosure of which is hereby incorporated by reference in its entirety.

TECHNICAL FIELD

The present invention relates generally to an accessory for smoking or a vapor producing device. More specifically, the present invention relates to diffusing exhaled exhaust or vapor from, for example, a vapor producing device.

BACKGROUND

Smoking tobacco or other plant material has notoriously been practiced in numerous cultures for many centuries. In the last decade or so, traditional smoking of tobacco has been banned in places such as bars, casinos, beaches and, even earlier, airline travel, where smoking was once permitted. As of late, electronic cigarettes have been used as a healthier alternative to smoking tobacco due to eliminating the bi-products generated through combustion of the tobacco and the "second-hand" smoke resulting from traditional cigarette smoking. Electronic cigarettes, or vapor producing devices, typically include a battery at its rear end, a cartridge that holds liquid, an electrical heating element that heats the liquid to produce vapor, a switch to activate the heating element and a mouth piece to inhale the vapor produced upon activating the heating element. The liquid usually contains a mixture of nicotine and flavorings, depending on the preference of the user.

Despite being a healthy alternative compared to traditional smoking products, electronic cigarettes have come under fire from those who feel that the vapor produced from the electronic cigarettes is harmful. Further, electronic cigarette users are still troubled by the same stigma that traditional cigarette smokers have endured for years: that the clouds of smoke or vapor exhaled by users are undesirable in public places and others that may inhale the vapor in a "second-hand" manner may result in harm, similar to "second-hand" smoke from traditional smoking products.

Therefore, it would be advantageous to provide a device, system, and/or method that will substantially eliminate any visible vapor exhaled by users inhaling vapor from a vapor producing device.

BRIEF SUMMARY OF THE INVENTION

Embodiments of the present invention are directed to various devices, systems and methods of providing a diffuser device for diffusing exhaled vapor that is inhaled from a vaper producing device. In one embodiment, the diffuser device includes a first diffuser portion, a second diffuser portion, and a filter. The first diffuser portion includes a first exterior surface and a first interior surface extending along a length. The first interior surface defines a first bore extending through the first diffuser portion along the length of the first diffuser portion, and the first interior surface defines a first ledge. The second diffuser portion includes a second exterior surface and a second interior surface, the second interior surface defining a second bore. The second diffuser portion is removably coupled to the first diffuser portion such that the second bore is coaxial with the first bore. The filter is a removable, disposable filter. Further, the disposable filter is positionable within the first bore of the first diffuser portion such that the disposable filter is positioned between the first ledge and an end of the second diffuser portion.

In another embodiment, the first diffuser portion includes one end defining a mouth exhaling portion for exhaling vapor through the first bore toward the disposable filter such that air is passable through the disposable filter and into the second bore to exit freely from the second diffuser portion. In another embodiment, the second diffuser portion includes lateral openings extending between the second exterior surface and the second interior surface, the lateral openings configured to vent exhaled air from the second bore. In another embodiment, the second bore of the second diffuser portion is configured to vent exhaled air from the second bore.

In another embodiment, the disposable filter includes a polymeric material configured to filter exhaled vaper. In another embodiment, the disposable filter includes a foam material configured to filter exhaled vaper. In another embodiment, the disposable filter includes a cylindrical shape extending between generally first and second flat ends, the first flat end abutting against the first ledge and the second flat end abutting against the end of the second diffuser portion.

In another embodiment, the first diffuser portion includes a tubular structure. In another embodiment, the first exterior surface of the first diffuser portion includes an axially extending concave surface. In another embodiment, the second diffuser portion includes lanyard coupling structure. In another embodiment, the interior surface of the second diffuser portion defines a second ledge, the second bore of the second diffuser portion sized and configured to receive the vapor producing device such that the vapor producing device abuts against the second ledge.

In accordance with another embodiment of the present invention, a diffuser device for diffusing exhaled vapor that is inhaled from a vaper producing device, is provided. The diffuser device includes a first tubular portion, a second tubular portion, and a removable, disposable filter. The first tubular portion includes a length and a first interior surface defining a first bore extending through the first tubular portion along the length, the first interior surface defining a first ledge. The second tubular portion includes a second interior surface such that the second interior surface defines a second bore. The second tubular portion is removably and rotatably coupled to the first tubular portion such that the second bore is coaxial with the first bore. The removable, disposable filter includes a cylindrical structure sized to be positioned within the first bore between the first ledge and an end of the second tubular portion.

In one embodiment, the first tubular portion includes one end exhibiting a mouth exhaling portion for exhaling vapor through the first bore toward the disposable filter such that air is passable through the disposable filter and into the second bore to exit freely from the second tubular portion. In another embodiment, the second tubular portion includes lateral openings extending from the second interior surface to an exterior surface, the lateral openings configured to vent exhaled air from the second bore. In another embodiment, the second bore of the second tubular portion is configured to vent exhaled air from the second bore.

In another embodiment, the disposable filter includes a polymeric material configured to filter exhaled vaper. In another embodiment, the disposable filter includes a cylindrical shape extending between generally first and second flat ends, the first flat end abutting against the first ledge and the second flat end abutting against the end of the second tubular portion.

In another embodiment, the first exterior surface of the first tubular portion includes an axially extending concave surface. In another embodiment, the second interior surface of the second tubular portion defines a second ledge, the second bore of the second tubular portion sized and configured to receive the vapor producing device such that the vapor producing device abuts against the second ledge.

In accordance with another embodiment of the present invention, a method of diffusing exhaled vapor that is inhaled from a vapor producing device, is provided. The method includes the steps of: inhaling a vapor from a vapor producing device; and exhaling the vapor through one end of a first tubular portion such that the vapor is filtered by a filter positioned in a first bore defined by an interior surface along a length and through the first tubular portion such that the filter is positioned between a first ledge defined by the interior surface in the first bore and an end of a second tubular portion rotatably coupled to the first tubular portion such that the second tubular portion includes a second interior surface that defines a second bore and such that the second bore is coaxial with the first bore.

In another embodiment, the method further includes replacing the filter with another new filter. In another embodiment, the method step of replacing includes rotatably decoupling the second tubular portion from the first tubular portion to remove the filter from the first tubular portion to then replace the filter with the new filter.

In accordance with another embodiment of the present invention, a method of diffusing exhaled vapor that is inhaled from a vapor producing device, is provided. The method includes the steps of: providing a diffuser device including a first tubular portion rotatably coupled to a second tubular portion with a disposable filter positioned within the first tubular portion such that the first tubular portion is coaxial with the second tubular portion and such that the filter is positioned and secured between a ledge defined by an interior surface of the first tubular portion and an end of the second tubular portion; inhaling a vapor from a vapor producing device; and exhaling the vapor through one end of the first tubular portion such that the vapor is diffused by the filter positioned in the first tubular portion so that air passes through the filter and vents from the second tubular portion.

In another embodiment, the method further includes replacing the filter with another new filter by rotatably decoupling the second tubular portion from the first tubular portion to remove the filter from the first tubular portion and to then replace the filter with the new filter. In another embodiment, the method of exhaling includes exhaling vapor through the diffuser device so that the air moves axially through the diffuser device and vents along an axis of the diffuser device. In another embodiment, the method of providing includes providing lateral vents defined in the second tubular portion.

In another embodiment, the method of exhaling includes exhaling vapor through the diffuser device so that the air disperses from the bore of the diffuser device through the lateral vents to disperse the air radially relative to an axis of the diffuser device. In another embodiment, the method further includes positioning a rear end of the vapor producing device within the second tubular portion such that, upon exhaling the vapor, the air disperses from the bore of the diffuser device through the lateral vents to disperse the air radially relative to an axis of the diffuser device.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
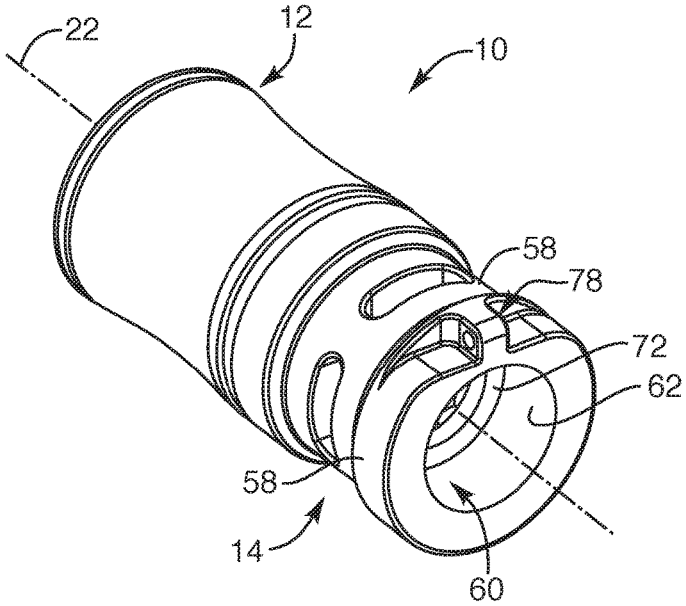
FIG. 1 is a perspective rear view of a diffuser device, according to an embodiment of the present invention.
Figure 2:
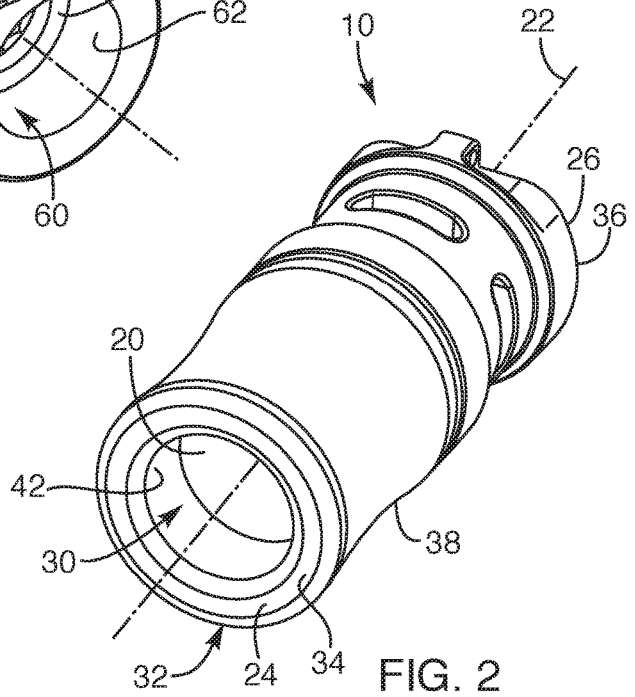
FIG. 2 is a perspective front view of the diffuser device of FIG. 1.
Figure 7:
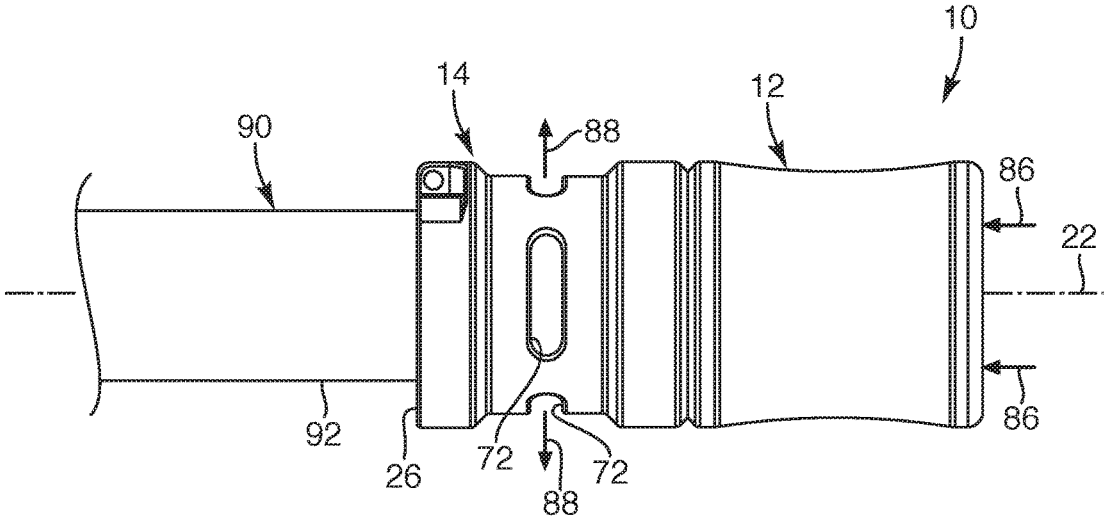
FIG. 7 is a side view of the diffuser device coupled to an electronic smoking device, depicting the electronic smoking device coupled to the rear piece, according to another embodiment of the present invention.

Referring to FIGS. 1 and 2, respective rear and front views of one embodiment of a diffuser device 10 are provided. The diffuser device 10 may be employed as a stand-alone device or may be removably coupled to a vapor producing device 90 (FIG. 7). As defined herein, the vapor producing device may be defined as an electronic cigarette, electronic cigars, vaporizers, and any known electronic device used to create vapor as a chemical delivery system to emit vapor. The diffuser device 10 may be sized and configured to diffuse exhaled vapor that is inhaled from a vapor producing device, such as electronic cigarette.

Figure 3:
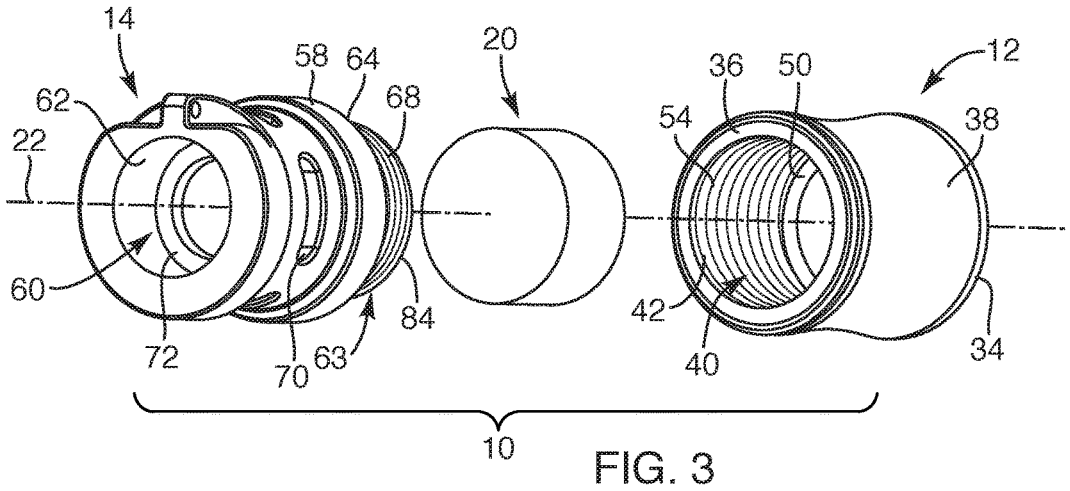
FIG. 3 is an exploded view of the diffuser device, depicting a mouth piece, a diffuser portion, and a rear piece, according to another embodiment of the present invention.

Referring to FIGS. 2 and 3, in one embodiment, the diffuser device 10 may include three primary components, such as, a first diffuser portion 12, a second diffuser portion 14, and a filter 20, of which each component may be positioned together in a coaxial manner along a longitudinal axis 22. The first diffuser portion 12 may be coupled to the second diffuser portion 14 so that the diffuser device 10 extends longitudinally between a front end 24 and a rear end 26 with the filter 20 positioned within a bore 30 defined through the diffuser device 10 and extending longitudinally therein, the filter 20 positioned along the axis 22 of the diffuser device 10. With this arrangement, the front end 24 may define a mouth contacting portion 32 or mouth piece through which a user may exhale vapor previously inhaled from the vapor producing device. The vapor then flows through the filter 20 so that the resulting air passing through the filter 20 may then exit from the second diffuser portion 14. In this manner, any contaminates or viewable vapor may be substantially diffused through the diffuser device 10.

With respect to FIGS. 2-4, and 6, the first diffuser portion 12 of the diffuser device 10 may include a length extending along the axis 22 of the first diffuser portion 12 between a first end 34 and a second end 36, the first end 34 being the front end 24 and the mouth contacting portion 32. The first diffuser portion 12 may also include a width and height, the width, for example, may be a diameter. In one embodiment, the first diffuser portion 12 may be a tubular structure having a first exterior surface 38 and a first interior surface 42, the first interior surface 42 defining a first bore 40 extending along the length of the first diffuser portion 12. The first bore 40 may define an inner radius 44 defined by the first interior surface 42. The first exterior surface 38 may define an outer radius 46. In one embodiment, the outer radius 46 may vary along the length of the first diffuser portion 12.

Further, referring to FIGS. 2, 3, 6 and 6A, the first interior surface 42 may include a first ledge 50. The first ledge 50 may extend within and be positioned at a mid portion of the first diffuser portion 12. In one embodiment, the first ledge 50 may extend radially along the first interior surface 42 such that the first ledge 50 defines a ledge radius 52. The ledge radius 52 may be smaller than the inner radius 44 at the second end 36 (and, in one embodiment, the first end 34) of the first diffuser portion 12. In another embodiment, the ledge radius 52 may be equal to the inner radius 44 at the first end 34 of the first diffuser portion 12. In another embodiment, the first ledge 50 may be in the form of multiple protrusions (not shown) extending radially inward from the first interior surface 42. In either case, the first ledge 50 may be configured to act as a back-stop for positioning the filter 20 within the first diffuser portion 12.

Figure 6:
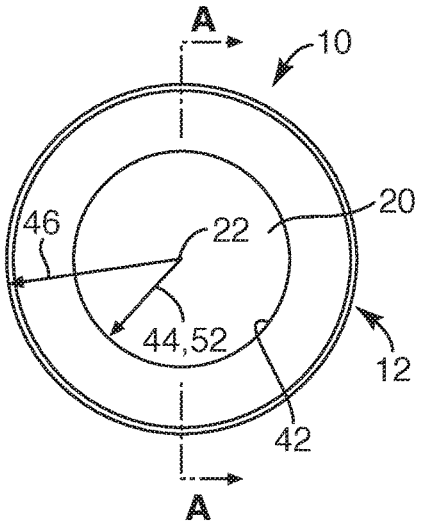
FIG. 6 is a front end view of the diffuser device.
Figure 6A:
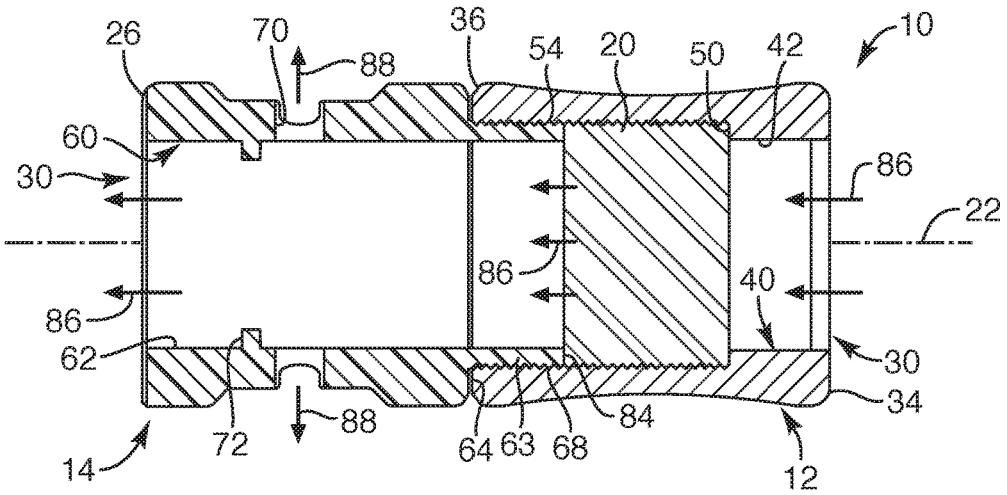
FIG. 6A is a cross-sectional view of the diffuser device taken along section line A-A of FIG. 6, according to another embodiment of the present invention.

With respect to FIGS. 2, 3, and 6A, in another embodiment, the first interior surface 42 may include first threads 54. The first threads 54 may extend between the first ledge 50 and the second end 36 along the first interior surface 42. Such threads 54 may be sized and configured to mate and couple with the second diffuser portion 14, discussed further below.

Figure 4:
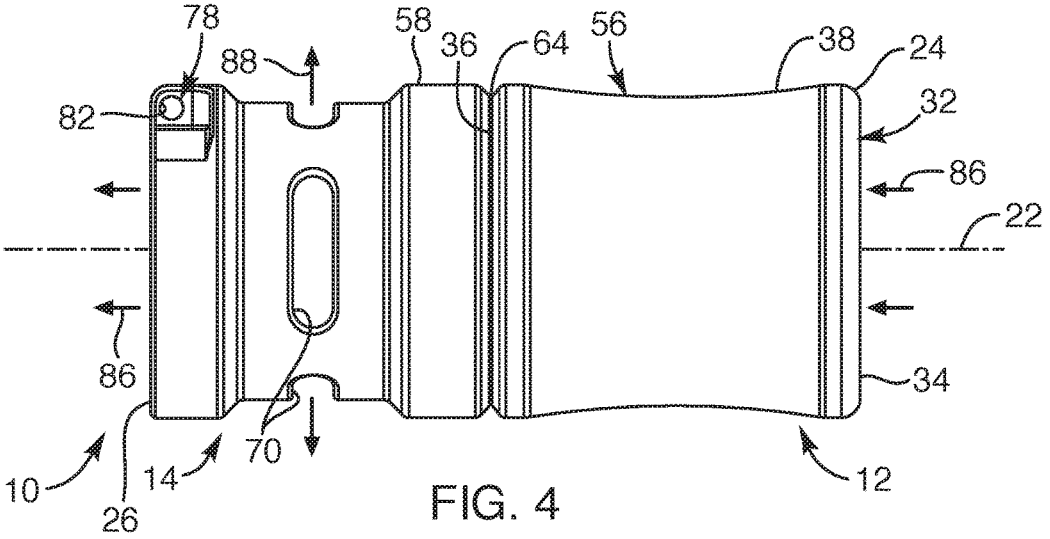
FIG. 4 is a side view of the diffuser device.

With reference to FIG. 4, in one embodiment, the first exterior surface 38 of the first diffuser portion 12 may include an axially extending concave surface 56 similar to an hourglass profile. Such axially extending concave surface 56 may provide a functional feature that facilitates a user's finger to seat comfortably around a portion of the first exterior surface 38 and over a mid portion of the first diffuser portion 12 with the user's thumb along an underside or positioned opposite the seated finger. In another embodiment, the first exterior surface 38 of the first diffuser portion 12 may extend axially parallel with the axis 22.

Referring now to FIGS. 1, 3 and 4, similar to the first diffuser portion 12, the second diffuser portion 14 of the diffuser device 10 may include a length extending along the axis 22 of the second diffuser portion 14 between opposite ends. The second diffuser portion 14 may also include a width and height, the width, for example, may be a diameter. In one embodiment, the second diffuser portion 14 may be a tubular structure having a second exterior surface 58 and a second interior surface 62, the second interior surface 62 defining a second bore 60 extending along the length of the second diffuser portion 14. The second bore 60 may extend axially along the axis 22 and through the second diffuser portion 14 such that the second bore 60 and first bore 40 may be coaxial.

Figure 5:
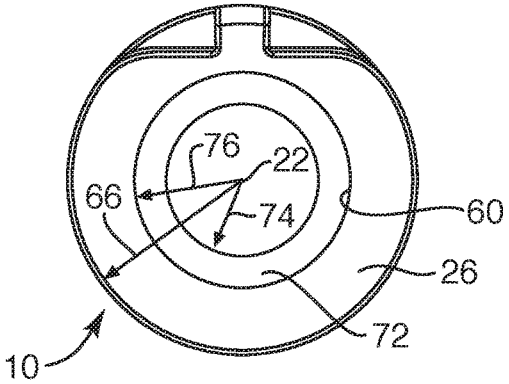
FIG. 5 is a rear end view of the diffuser device.

With respect to FIGS. 3, 4 and 6A, the second exterior surface 58 of the second diffuser portion 14 may include an extension 63, the extension 63 extending axially from a first step 64 defined in the second exterior surface 58 of the second diffuser portion 14. In one embodiment, the extension 63 may be a male connector sized and configured to be coupled to a female connector or the first bore 40 of the first diffuser portion 12. The extension 63 may be defined relative to the first step 64 defined by the second exterior surface 58 of the second diffuser portion 14. The first step 64 may include an outer radius 66 (FIG. 5) similar to the outer radius 46 at the second end 36 of the first diffuser portion 12. In one embodiment, the second exterior surface 58 of the extension 63 may include second threads 68 that correspond to the first threads 54 defined in the first interior surface 42 adjacent to the second end 36 of the first diffuser portion 12. With this arrangement, the extension 63 of the second diffuser portion 14 may removably and rotatably couple to the first diffuser portion 12.

Further, the second diffuser device 14 may include a mid portion defining multiple lateral openings 70 therein. Such lateral openings 70 may extend laterally from the second interior surface 62 to the second exterior surface 58. The second lateral openings 70 may be sized and configured to disperse air exhaled through the filter 20 and then from the second bore 60 so that at least some of the air may disperse in a radial manner relative to the axis 22 of the diffuser device 10. In one embodiment, the lateral openings 70 defined in the second diffuser portion 14 may be elongated to define an opening length between ends of the elongated lateral openings 70 defined in the second exterior surface 58. In another embodiment, the lateral openings 70 may be circular. In another embodiment, the lateral openings 70 may extend so that the air dispersed therefrom flows generally perpendicular relative to the axis 22 of the second diffuser portion 14. In another embodiment, the lateral openings 70 may include four lateral openings, each lateral opening 70 being oppositely positioned relative to another lateral opening.

With respect to FIGS. 1, 3, 5 and 6A, in one embodiment, the second interior surface 62 of the second diffuser portion 14 may include a second ledge 72. The second ledge 72 may extend radially within the second bore 60. In another embodiment, the second ledge 72 may be in the form of multiple protrusions extending radially relative to the second interior surface 62. The second ledge 72 may be positioned in a set-back location from the rear end 26 of the second diffuser portion 14 between the lateral openings 70 and the rear end 26. The second ledge 72 may include a second ledge radius 74 that may be smaller than an inner radius 76 of the second bore 60 at the rear end 26 of the second diffuser portion 14 of the diffuser device 10. Such second ledge 72 may be positioned to act as a back stop for a rear end of a vapor producing device 90 (see FIG. 7), discussed further below.

Referring to FIGS. 1 and 4, another feature that may be included with the second diffuser portion 14 may include a coupling portion 78. Such coupling portion 78 may be utilized to couple to a lanyard, for example, or be coupled to a key ring, or the like. The coupling portion 78 may be defined in the second exterior surface 58 of the second diffuser portion 14 and be positioned adjacent the rear end 26 of the second diffuser portion 14 of the diffuser device 10. The coupling portion 78 may define an aperture 82 extending through a portion of the second exterior surface 58.

With respect to FIGS. 3 and 6A, as previously set forth, a filter 20 may be positioned within the first bore 40 of the first diffuser portion 12. The filter 20 may be cylindrically shaped with opposite flat sides and be sized and configured to fit snug within the first bore 40 with an interference type fit. Further, the filter 20 may be positioned by inserting the filter 20 into the first bore 40 at the second end 36 of the first diffuser portion 12 such that the filter 20 is positioned inset relative to the second end 36. The extension 63 or male connector of the second diffuser portion 14 may then be moved axially into the first bore 40 to push the filter 20 and abut the filter 20 against the first ledge 50 defined in the first bore 40 of the first diffuser portion 14. In this manner, an end 84 of the extension 63 may abut against and sandwich the filter 20 against the first ledge 50. As previously set forth, in one embodiment, the extension 63 of the second diffuser portion 14 may include second threads 68 to correspond with first threads 54 of the first interior surface 42 of the first diffuser portion 12 so that the extension 63 of the second diffuser portion 14 may axially move and be rotatably coupled to the first diffuser portion 12. As the extension 63 of the second diffuser portion 14 moves axially, the end 84 of the extension 63 pushes the filter 20 further into the first bore 40 to abut tightly between the end 84 of the extension 63 and the first ledge 50. With this arrangement, the tight abutment of the filter 20 between the first ledge 50 extending radially around the first interior surface 42 and the radially extending end 84 of the extension 63 may provide a compressive seal so that exhaled vapor substantially passes through the filter 20, rather than seeping around the filter 20.

In one embodiment, the filter 20 may be disposable and replaceable. For example, the filter 20 may be removed from the first bore 40 by decoupling the second diffuser portion 14 from within the first bore 40. Such may be employed by axially moving (which may be by reversibly rotating) the second diffuser portion 14 relative to the first diffuser portion 12. Once decoupled, the filter 20 may be pushed toward the second end 36 and removed from the first bore 40 via the user's finger or an elongated element. Upon the old filter being removed from the first bore 40, a new filter may replace the old filter by positioning the new filter in the first bore 40, as described above.

With respect to FIGS. 4 and 6A, the diffuser device 10, with the filter 20 properly positioned within the first bore 40, may be employed to diffuse exhaled vapor. In one embodiment, as indicated by arrows 86, the exhaled vapor may axially move through the first bore 40 and through the filter 20 and continue moving axially through the second bore 60 and out the rear end 26 of the diffuser device 10. In another embodiment, the exhaled vapor may axially move through the first bore 40 and through the filter 20 and continue moving axially through the second bore 60 and out the rear end 26 and also vent through the lateral openings 70 defined in the second diffuser portion 14, as depicted by arrows 88. In another embodiment, the rear end 26 of the diffuser device 10 may be blocked or closed such that the second bore does not extend to the rear end 26, in which the exhaled vapor may move axially through the first bore 40 and move axially through a portion of the second bore 60, but then exclusively move radially relative to the axis 22 to vent through the lateral openings 70 defined in the second diffuser portion 14. Dispersal of air radially from the second diffuser portion 14 may further dissipate any potentially visible vapor that may pass through the filter 20.

With respect to FIGS. 6A and 7, another embodiment of the diffuser device 10 is depicted. In this embodiment, the diffuser device 10 may act as a stand-alone diffuser device, as depicted in previous embodiments, or the diffuser device 10 may be coupled to a rear portion 92 of a vapor producing device 90. The rear portion 92 of the vapor producing device 90, or battery portion, may be inserted into the second bore 60 at the rear end 26 of the diffuser device 10. The second ledge 72 defined in the second interior surface 62 of the second diffuser portion 14 may act as a back stop to indicate to the user that the rear portion 92 of the vapor producing device 90 is fully inserted. Further, the rear portion 92 of the vapor producing device 90 may be coupled with an interference fit with, for example, one or more rubber O-rings (not shown), positioned in notches (not shown) defined in the second interior surface 62 of the second diffuser portion 14 between the second ledge 72 and the rear end 26 of the second diffuser portion 14. Other coupling structures may also be employed, as known to one of ordinary skill in the art, such as various adapters (not shown) sized to fit various known rear portion sizes of vapor producing devices. With this arrangement, exhaled vapor may axially move through the first bore 40 such that air passes through the filter 20 in an axial direction, as indicated by arrows 86, to then move axially through a portion of the second bore 60 and then move laterally, as indicated by arrows 88, through the lateral openings 72 defined in the second diffuser portion 14 such that the air moves laterally or transverse relative to the axis 22. In one embodiment, the air moves through the lateral openings 72 so as to move perpendicular relative to the axis 22. The air moving through the multiple lateral openings 72 disperses the air, and any visible left-over vapor, in multiple radial directions thereby further diffusing the vapor and/or air.

The first and second diffuser portions 12, 14 of the diffuser device 10 may be made from polymeric materials and/or metallic materials, or component combinations thereof. For example, polymeric materials may include polyvinyl chloride, polyoxymethylene, acetal homopolymer, such as Delrin®, or any other suitable polymeric material known in the art, and metallic materials may include stainless steel, aluminum, titanium, or any other suitable metallic materials or alloys/combinations thereof known in the art. The first and second diffuser portions 12, 14 may be formed with molding and or machining processes or any other suitable manufacturing technique known by one of ordinary skill in the art, such as three dimension printing. The filter 20 may be formed of a polymeric material, such as a reticulated and/or non-reticulated foam material, or any other known polymeric filter type materials known in the art, such as polyurethane. Further, the filter may include layers of various types of filter materials. In one embodiment, the filter may include a chemical integrated with the polymeric material. The filter 20 may be initially formed as an elongated bar and then sliced to the appropriate size.

With reference to FIGS. 1 and 3, the diffuser device 10 may be prepared and sold as a kit, having instructions for assembly and use, with multiple replaceable filters 20 within the kit. For example, the kit may include one or more diffuser devices 10, each with its first and second diffuser portions 12, 14, and multiple replaceable filters 20. The diffuser devices 10 may include various color schemes that may be mixed and matched with the various first and second diffuser portions 12, 14 therein. In addition, the kit may include various adapters so that the rear end 26 of the diffuser device may fit with the various types of vapor producing devices in the industry. In addition, the kit may include a lanyard that may be sized and configured to couple to the lanyard coupling portion 78 of the diffuser device.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A diffuser device for diffusing exhaled vapor that is inhaled from a vaper producing device, the diffuser device comprising:

a first diffuser portion including a first exterior surface and a first interior surface extending along a length, the first interior surface defining a first bore extending through the first diffuser portion along the length of the first diffuser portion, the first interior surface defining a first ledge;

a second diffuser portion including a second exterior surface and a second interior surface, the second interior surface defining a second bore, the second diffuser portion removably coupled to the first diffuser portion such that the second bore is coaxial with the first bore; and a removable, disposable filter, the disposable filter positionable within the first bore of the first diffuser portion such that the disposable filter is positioned between the first ledge and an end of the second diffuser portion.

2. The diffuser device of claim 1, wherein the first diffuser portion comprises one end defining a mouth exhaling portion for exhaling vapor through the first bore toward the disposable filter such that air is passable through the disposable filter and into the second bore to exit freely from the second diffuser portion.

3. The diffuser device of claim 1, wherein the second diffuser portion comprises lateral openings extending between the second exterior surface and the second interior surface, the lateral openings configured to vent exhaled air from the second bore.

4. The diffuser device of claim 1, wherein the second bore of the second diffuser portion is configured to vent exhaled air from the second bore.

5. The diffuser device of claim 1, wherein the disposable filter comprises a polymeric material configured to filter exhaled vaper.

6. The diffuser device of claim 1, wherein the disposable filter comprises a cylindrical shape extending between generally first and second flat ends, the first flat end abutting against the first ledge and the second flat end abutting against the end of the second diffuser portion.

7. The diffuser device of claim 1, wherein the interior surface of the second diffuser portion defines a second ledge, the second bore of the second diffuser portion sized and configured to receive the vapor producing device such that the vapor producing device abuts against the second ledge.

8. A diffuser device for diffusing exhaled vapor that is inhaled from a vaper producing device, the diffuser device comprising:

a first tubular portion including a length and a first interior surface defining a first bore extending through the first tubular portion along the length, the first interior surface defining a first ledge;

a second tubular portion including a second interior surface, the second interior surface defining a second bore, the second tubular portion removably and rotatably coupled to the first tubular portion such that the second bore is coaxial with the first bore; and a removable, disposable filter having a cylindrical structure sized to be positioned within the first bore between the first ledge and an end of the second tubular portion.

9. The diffuser device of claim 8, wherein the first tubular portion comprises one end exhibiting a mouth exhaling portion for exhaling vapor through the first bore toward the disposable filter such that air is passable through the disposable filter and into the second bore to exit freely from the second tubular portion.

10. The diffuser device of claim 8, wherein the second tubular portion comprises lateral openings extending from the second interior surface to an exterior surface, the lateral openings configured to vent exhaled air from the second bore.

11. The diffuser device of claim 8, wherein the second bore of the second tubular portion is configured to vent exhaled air from the second bore.

12. The diffuser device of claim 8, wherein the disposable filter comprises a polymeric material configured to filter exhaled vaper.

13. The diffuser device of claim 8, wherein the disposable filter comprises a cylindrical shape extending between generally first and second flat ends, the first flat end abutting against the first ledge and the second flat end abutting against the end of the second tubular portion.

14. The diffuser device of claim 8, wherein the first exterior surface of the first tubular portion comprises an axially extending concave surface.

15. The diffuser device of claim 8, wherein the second interior surface of the second tubular portion defines a second ledge, the second bore of the second tubular portion sized and configured to receive the vapor producing device such that the vapor producing device abuts against the second ledge.

16. A method of diffusing exhaled vapor that is inhaled from a vapor producing device, the method comprising:

providing a diffuser device including a first tubular portion rotatably coupled to a second tubular portion with a disposable filter positioned within the first tubular portion such that the first tubular portion is coaxial with the second tubular portion and such that the filter is positioned and secured between a ledge defined by an interior surface of the first tubular portion and an end of the second tubular portion;

inhaling a vapor from a vapor producing device; and exhaling the vapor through one end of the first tubular portion such that the vapor is diffused by the filter positioned in the first tubular portion so that air passes through the filter and vents from the second tubular portion.

17. The method according to claim 16, wherein the exhaling comprises exhaling vapor through the diffuser device so that the air moves axially through the diffuser device and vents along an axis of the diffuser device.

18. The method according to claim 16, wherein the providing comprises providing lateral vents defined in the second tubular portion.

19. The method according to claim 18, wherein the exhaling comprises exhaling vapor through the diffuser device so that the air disperses from the bore of the diffuser device through the lateral vents to disperse the air radially relative to an axis of the diffuser device.

20. The method according to claim 18, further comprising positioning a rear end of the vapor producing device within the second tubular portion such that, upon exhaling the vapor, the air disperses from the bore of the diffuser device through the lateral vents to disperse the air radially relative to an axis of the diffuser device.

* * * * *